US008555989B1

(12) United States Patent
Agajanian

(10) Patent No.: US 8,555,989 B1
(45) Date of Patent: Oct. 15, 2013

(54) SWIMMING POOL SKIMMER PORT FLOW DIVERTER AND FIRE SUPPRESSION SYSTEM

(76) Inventor: Harry Agajanian, Monrovia, CA (US)

( * ) Notice: Subject to any disclaimer, the term of this patent is extended or adjusted under 35 U.S.C. 154(b) by 381 days.

(21) Appl. No.: 12/930,100

(22) Filed: Dec. 29, 2010

(51) Int. Cl.

| | |
|---|---|
| ***A62C 35/68*** | (2006.01) |
| ***A62C 35/64*** | (2006.01) |
| ***A62C 35/58*** | (2006.01) |
| ***E04H 4/12*** | (2006.01) |
| ***E04H 4/16*** | (2006.01) |

(52) U.S. Cl.
USPC ..... 169/13; 169/5; 4/494; 4/507; 210/167.1

(58) Field of Classification Search
USPC ..... 169/5, 13; 4/490, 494, 496, 507, 509, 4/512; 210/167.1, 167.12, 416.2
See application file for complete search history.

(56) References Cited

U.S. PATENT DOCUMENTS

| | | | | |
|---|---|---|---|---|
| 4,185,333 | A * | 1/1980 | Ortega | 4/489 |
| 4,776,908 | A * | 10/1988 | Sapp | 156/94 |
| 5,125,458 | A * | 6/1992 | Berman | 169/16 |
| 5,366,021 | A * | 11/1994 | Coleman | 169/16 |
| 5,604,939 | A * | 2/1997 | Widener | 4/507 |
| 2004/0045613 | A1* | 3/2004 | Hinojosa et al. | 137/625.47 |
| 2006/0059615 | A1* | 3/2006 | Beaton | 4/507 |
| 2009/0020164 | A1* | 1/2009 | Reed | 137/270 |
| 2010/0084325 | A1* | 4/2010 | Parks et al. | 210/167.12 |
| 2011/0114341 | A1* | 5/2011 | Claffey et al. | 169/13 |
| 2011/0154565 | A1* | 6/2011 | Parks et al. | 4/496 |

* cited by examiner

*Primary Examiner* — Darren W Gorman
(74) *Attorney, Agent, or Firm* — William L. Chapin

(57) ABSTRACT

A novel skimmer port flow diverter for use with swimming pools having a dual port skimmer apparatus includes an inverted U-shaped conduit having at each lower end of a pair of vertically downwardly disposed legs thereof a tapered elastomeric bushing insertable into suction and main-drain ports, respectively, at the bottom of a skimmer box to thus enable substantially all of the water contained in a swimming pool basin to be drawn out at the maximum flow rate of which an existing swimming pool circulation and filtration pump is capable. A swimming pool fire suppression system includes the novel skimmer port flow diverter temporarily inserted into the main-drain and suction inlet ports of a swimming pool skimmer, and a three-port, two-way selector valve having an inlet port connected to the discharge port of the swimming pool pump, a first outlet port connected to the inlet port of a pool filter, a second outlet port connected to a fire hose, and a valve control lever for directing water discharged from the pump alternatively to the filter and the fire hose.

16 Claims, 7 Drawing Sheets

AA
Q
Z
Y
KK
JJ
BB
R
CC
S
T
DD
O
E
V
W

Q
Y
GG
FF
BB
V
R
O
P
Z
AA 24
22
25R
25L
26R
26L
R
T
Q
S
DD
O
W
E
MAIN DRAIN, W
22
Q
25L
S
25R
R
T
DD
26R
26L
O
V
MAIN DRAIN
W
E, SUCTION LINE
FIRE HOSE COUPLER, 35
32
HOSE NOZZLE, 36
C, PUMP
29
29C
28
33
30
RETURN
FIRE HOSE, 34
31
27, 3 PORT, 2 WAY SELECTOR VALVE
F
37

SWIMMING POOL SKIMMER PORT FLOW DIVERTER AND FIRE SUPPRESSION SYSTEM

BACKGROUND OF THE INVENTION

A. Field of the Invention

The present invention relates to methods and apparatus for suppressing fires. More particularly, the invention relates to a method and apparatus for effectively pumping water from a swimming pool onto structures or areas which have caught fire, or which are threatened with being ignited by an approaching fire.

B. Description of Background Art

The dedication and effectiveness of local fire fighting agencies and professional fire fighters has earned the respect and trust of U.S. residents. For that reason, most home owners seldom worry about how they would deal with a fire which has broken out on their property, or an approaching brush fire, for example. However, recent brush fires and forest fires in various parts of the country have diminished somewhat long-held confidence which homeowners have had in the ability of local fire fighters to respond quickly to fires which threaten a homeowner's property or life. This change of attitude has resulted in part from observations that rapidly spreading brush fires or forest fires can overwhelm resources of the most well-equipped and dedicated fire fighting services, to the extent of sometimes preventing fire fighters from even reaching threatened properties until long after they have burned to the ground.

For the foregoing reasons, many people are taking steps to prepare themselves to independently prevent or extinguish fires on their property when professional fire fighters are unavailable to do so. Unfortunately, such self-help measures frequently consist essentially of watering down a house or other structure using a garden hose connected to the homeowner's municipal water supply. Such methods are usually woefully inadequate, because available water pressure and flow rates available from a garden hose are simply not adequate to soak down a structure of any significant size, or to extinguish any but very small fires. Moreover, in the event of large scale emergencies, such as fires which have broken out over large areas, water pressure and hence available water flow rates from municipal water lines may diminish to a trickle.

In response to concerns about providing fire suppression capabilities which do not rely on professional fire fighting services, a number of types of systems have been proposed which utilize water held in a swimming pool basin or spa. One such system type uses a pump driven by a gasoline engine. The pump has an inlet port which is connected to a flexible hose that may be immersed into the water held in a swimming pool or spa, and has an outlet port connected to a nozzle through a length of fire hose.

Another type of fire fighting system for use in association with homes equipped with swimming pools is disclosed in Coleman, U.S. Pat. No. 5,366,021. That system includes a three-port, two position auxiliary valve which is inserted into the plumbing of the swimming pool water filtration and circulation system, between the outlet port of an existing swimming pool pump and pool filter. The auxiliary valve has an inlet port which is coupled by a pipe to the outlet port of the pump and a first outlet port coupled through another pipe to the pool filter. The system includes a PVC pipe connected at one end to a second outlet port of the three-port auxiliary valve, and at the other end to a fire hose which has a nozzle at the other end of the hose.

With the auxiliary valve in a first position, all of the water discharged from the pump outlet port is conveyed to the pool filter, so the pool water circulation and filtering system functions in a conventional manner. However, if water is needed for fire suppression purposes, the auxiliary valve is reconfigured by turning a valve handle to convey water discharged by the pool pump out through the second outlet port of the auxiliary valve, and hence through the outlet pipe, fire hose and nozzle.

The system disclosed in Coleman would seem to provide an effective means for pumping water from a swimming pool through a fire hose for fire suppression purposes. However, because of the design of the system disclosed in Coleman, and the design of most swimming pool water circulation systems, only a small percentage of the total volume of water contained in the basin of a conventional swimming pool may be pumped out at a high flow rate and used to suppress fires, for reasons which are explained below. Limitations of prior art fire suppression system utilizing water contained in a swimming pool were a motivating factor in the present inventor's invention of a fire suppression system for use with swimming pools.

OBJECTS OF THE INVENTION

An object of the present invention is to provide a fire suppression system which utilizes a water circulation pump of a swimming pool water filtration system to pump water contained in the pool through a fire hose.

Another object of the invention is to provide a fire suppression system which is useable with swimming pools of the type having a skimmer box in which are located suction and main-drain inlet ports and an equalizer or float type diverter valve.

Another object of the invention is to provide a fire suppression system for use with swimming pools of the type having a dual port simmer, the invention including a novel skimmer port flow diverter assembly which enables substantially all of the water in the pool to be pumped out and used for fire suppression, at the maximum flow rate of the pump.

Another object of the invention is to provide a skimmer port flow diverter assembly which includes a tubular conduit that has at opposite ends thereof tapered elastomeric bushings insertable simultaneously into spaced apart bore openings comprising entrance ports of suction and main-drain lines of a swimming pool skimmer box to thereby form a sealed path for water flowing out from the main-drain line through the conduit, and into the suction line, in response to suction in the suction line.

Another object of the invention is to provide a fire suppression system for use with swimming pools which includes a two-way selector valve connected by plumbing between the pump and filter of a swimming pool; a pipe, flexible fire hose and nozzle coupled to the output port of the auxiliary valve, and a novel diverter assembly insertable into the suction and main-drain ports of a skimmer box which enables the system to pump essentially all of the water contained in the pool out through the fire hose nozzle at the full pump circulation flow rate.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a fire suppression system which is connectable to the water filtration and circulation system of a swimming pool. The fire suppression system according to the present invention utilizes the pump of an existing swimming pool water filtration and circulation system to pump water from the basin of the pool through a fire hose, and can be used to pump essentially all, if necessary, of the water out of the pool basin at the maximum normal pump flow rate. The system according to the invention is particularly well suited for use with swimming pools of the type which include a leaf and debris skimmer box that is located in a vertically disposed well located outside the pool basin, the well being adjacent to a vertical side wall of the basin.

A main embodiment of a fire suppression system according to the present invention is intended for use with swimming pools which have a leaf skimmer of the type that has in the base of a box-like skimmer housing a pair of circular ports, including a first, suction inlet port which is coupled through a suction inlet pipe to the suction inlet port of the pool circulation pump and a second, main-drain port which is connected through a main-drain pipe to a water circulation inlet port called a "main drain" which is located at the bottom of the swimming pool basin, near its lowest elevation.

In normal operation of skimmers of the type described above, suction provided by the pump at the suction inlet port of the skimmer draws in water from the upper surface layer of water in the pool basin over the edge of a pivotable weir gate. The weir gate is located in a horizontally elongated, rectangularly-shaped duct in a side of the skimmer housing box, which is located in a vertical well sunk into the ground adjacent to a vertical side wall of the pool.

The weir gate is attached at a bottom edge thereof by a horizontally disposed hinge to the skimmer housing box duct. The duct has a rectangularly-shaped opening which protrudes through a side wall of the swimming pool, a short distance below the upper edge of the pool, the opening being in contact with water in the pool.

Water drawn over the upper edge of the weir gate by suction of the skimmer suction inlet port flows downwardly over the upper edge of the weir gate in a waterfall effect into the skimmer housing and towards the suction inlet port, thus carrying surface debris such as leaves into a removable perforated basket which fits into a cavity of the skimmer box above the suction inlet port. Periodically, a removable lid which fits into the upper opening of the skimmer housing may be removed, enabling the basket to be lifted from the skimmer box, emptied of debris and returned to the skimmer box, and the lid reinstalled.

Some skimmers utilize a conventional lever operated, three-port two-way diverter valve which has an outlet port connected to the suction line of the pump, one inlet suction port connected through a pipe to the skimmer suction inlet port, and one suction inlet port connected through another pipe to the main drain. This arrangement enables the relative percentages of water drawn from the pool through the main-drain and the skimmer to be manually controlled by adjusting the position of the lever of the diverter valve. However, perhaps more than 90 percent of swimming pools, of the type the present system is intended to be used with, employ a two-port skimmer and a float-type skimmer equalizer or diverter valve to adjust relative flow rates between the skimmer weir gate inlet and main-drain inlet.

Float-type skimmer equalizer valves used in the majority of existing swimming pools have an annular ring-shaped base which fits conformally over a flat, circular base of a vertically disposed, hollow cylindrically-shaped part of a skimmer box. The base of this part of the skimmer box has therein a pair of adjacent circular openings or ports, including a suction inlet port which is connected to the pump through a suction inlet line and a pool main-drain port which is connected to the main-drain of the pool through a main-drain line.

The skimmer equalizer float valve has an upper circular inverted concave disk-shaped top plate which is of smaller diameter than the annular ring-shaped base plate, and is located concentrically with respect to the base plate.

The base plate and top plate of the skimmer float valve are held in fixed relationship by a six or more thin, radially disposed ribs which extend upwardly and radially inwardly from the upper surface of the base ring to the top plate. The top plate, ribs and base ring form therebetween a cage in which is located a pancake-shaped sealed hollow plastic float that is normally buoyed up by water within the skimmer housing to an upper position in which the upper flat surface of the float is lodged against the underside of the top plate of the float valve. In this position, water is drawn into the skimmer box by suction at the pump inlet port and flows in a water fall effect over the upper edge of the weir gate, downwardly and radially inwardly through the space between the bottom surface of the float, downwardly through the central opening of the float valve base ring, and thence into the suction inlet port opening in the base of the skimmer housing, which port is a circular opening flush with the base of the housing.

If the water level in the pool falls below that required to provide flow over the upper edge of the weir gate and into the pump suction inlet port of the skimmer via the pathway discussed above, suction will quickly completely empty the water contained in the skimmer housing. Such action causes the skimmer float, which is no longer buoyed up by water, to fall under the force of gravity onto the central circular entrance opening perforation through the float valve base plate, thus sealing that opening against the ingress of air which could cause damage to the pool pump.

With the float valve sealing the central entrance opening of the float valve base plate, water flow from the pool main-drain inlet port to the suction inlet port is enabled because the valve base plate has a concave lower surface which thus forms a concave space between the upper surface of the skimmer housing base and the lower surface of the valve base plate, the space forming airtight passageways between the two ports.

Water flowing upwardly from the drain port and horizontally and downwardly into the suction inlet port in the base of the skimmer housing enables water to be supplied to the pump and recirculated through the filter and water inlet ports of the pool. However, because of the restricted size of this flow path cross-section, the water flow rate is decreased to a small fraction, typically about one-tenth, of the normal pump flow rate. As a consequence, if water pumped from a pool of this type causes the level of water level to drop below that required to sustain flow through the skimmer weir gate opening, typically a drop of only about 6 to 8 inches, the water flow rate from any auxiliary valve and fire hose arrangement coupled to the pool water circulation system would drop to about one-tenth the normal flow rate. And, since the minimum practical flow rate for fire fighting purposes has been determined to be only slightly less than the maximum flow rate of a typical swimming pool circulation system, such a system would be unsuitable for pumping any but a small fraction of the total volume of water contained in the pool at a rate useful for fire fighting, i.e., a volume contained in at most the upper 8 inches, out of an average depth of six to eight feet or more.

The present invention includes a novel swimming pool skimmer port flow diverter assembly which permits substantially all of the water contained in a swimming pool to be pumped out of the pool at the maximum normal flow rate of the pool pump, and used to fight fires. The diverter assembly according to the present invention includes a length of PVC pipe which has a bore diameter at least as great as those of the suction inlet line and main-drain ports of a typical skimmer. The pipe is formed into the shape of an inverted U which has an upper horizontal leg and at the opposite ends thereof, two parallel vertically disposed downwardly depending legs of equal length. The lower end of each vertical leg of the diverter assembly has attached thereto a tapered, inverted frusto-conically shaped elastomeric bushing which fits coaxially over the leg, and is insertably receivable in a fluid pressure-tight sealing contact into the upper entrance openings of the suction and main-drain ports, respectively, at the bottom of a skimmer housing. The function and manner of use of the novel skimmer port diverter, bypass or bridge assembly are described below.

A fire suppression apparatus system for use with swimming pools according to the present invention includes a three-port, two-way selector valve. The selector valve has an inlet port which is coupled by an inlet pipe to the outlet or discharge port of a swimming pool water circulation pump, and a first outlet port which is connected by a first, normal-use outlet pipe to the pool filter. The selector valve may be installed in the pool water circulation plumbing at the time the pool equipment is initially installed.

In those situations where the fire suppression system according to the present invention is to be retrofitted to an existing swimming pool water circulation system, a length of pipe originally connecting the outlet or discharge port of the circulation pump to the inlet port of the filter is severed and removed. Since most swimming pools use PVC pipe in their plumbing systems, removal of the required length of pipe from the pump discharge path may be readily accomplished by making two longitudinally spaced apart hack-saw cuts through the pipe. The cut end of the pipe connected to the pump is then coupled to the inlet port of the selector valve, using a conventional fluid pressure-tight coupler. In the same fashion, the cut end of the filter inlet pipe is coupled in a fluid pressure-tight connection to a first outlet port of the selector valve.

A fire suppression system according to the present invention includes a length of pipe coupled at one end thereof in a fluid pressure-tight connection to the second outlet port of the selector valve. The other end of the pipe is coupled to an inlet end of a standard flexible fire hose, preferably using a quick-disconnect coupler. A standard nozzle suitable for fire fighting is attached to the outlet end of the fire hose. The fire hose may be stored in a folded configuration, or optionally wound around a rotatable storage reel.

To use the fire suppression system according to the present invention, a circular skimmer box lid which fits into the upper circular entrance opening of the skimmer box flush with the surface of the deck that peripherally surrounds the pool is removed, allowing access to the interior of the skimmer housing. The skimmer filter basket and skimmer float valve are then lifted upwards and out from the skimmer housing.

Next, the skimmer port diverter assembly described above is positioned vertically above the upper entrance opening of the now vacant skimmer housing, and pushed downwards into the skimmer housing until the two tapered rubber plugs at the lower ends of the diverter assembly legs seat in the upper entrance openings of the suction inlet port and main-drain port, which are located side-by-side in the base of the skimmer housing. Preferably, installation of the diverter assembly is done with the pool pump operating, suction on the plug at the end a diverter assembly leg inserted into the suction inlet port, facilitating secure coupling between the diverter assembly pipe bore and both the suction inlet and main-drain bores.

A control lever of the selector valve of the fire suppression apparatus according to the present invention is then manually re-positioned to re-route discharge water flow from the pool pump from a normal-use position, conducted to the filter, to a fire-fighting position, conducted through the second outlet port of the selector valve through the outlet pipe, fire hose and nozzle.

With the fire suppression apparatus according to the present invention configured as described above, water contained in the pool basin may be pumped through the fire hose at the maximum discharge pressure and flow rate of which the pump is capable, until the water level in the pool has dropped to the level of the main-drain. And, since the main-drain is customarily located at the lowest elevation of a pool, the fire suppression apparatus according to the present invention is useable to pump from the pool essentially all of the water contained in the pool at full pressure to fight fires.

DESCRIPTION OF THE PREFERRED EMBODIMENTS

FIGS. 1-10 illustrate a fire suppression system using a swimming pool and skimmer port flow diverter according to the present invention.

Figure 1:
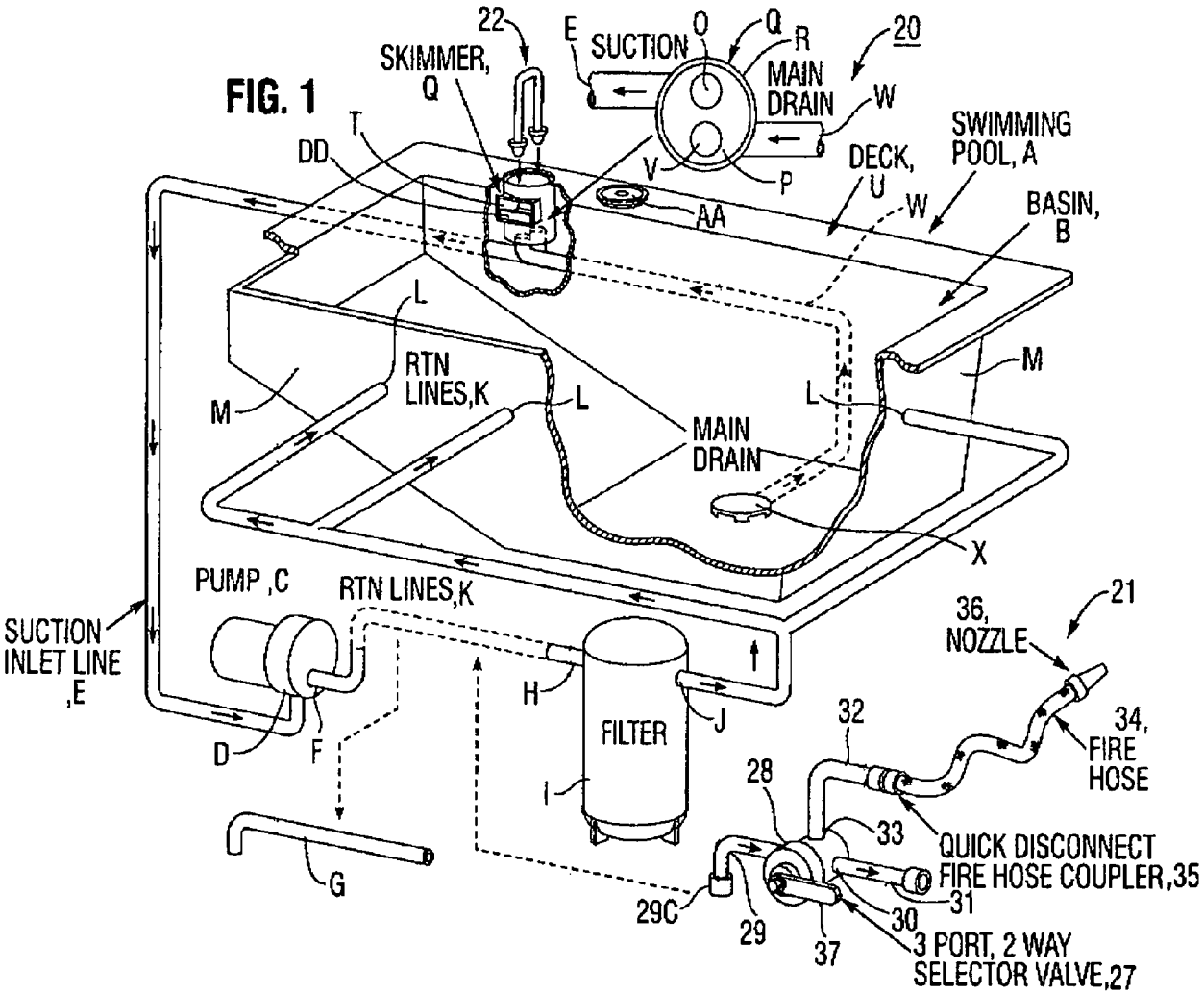
FIG. 1 is a partly diagrammatic view of a fire suppression system using swimming pool and skimmer port diverters according to the present invention.
Figure 2A:
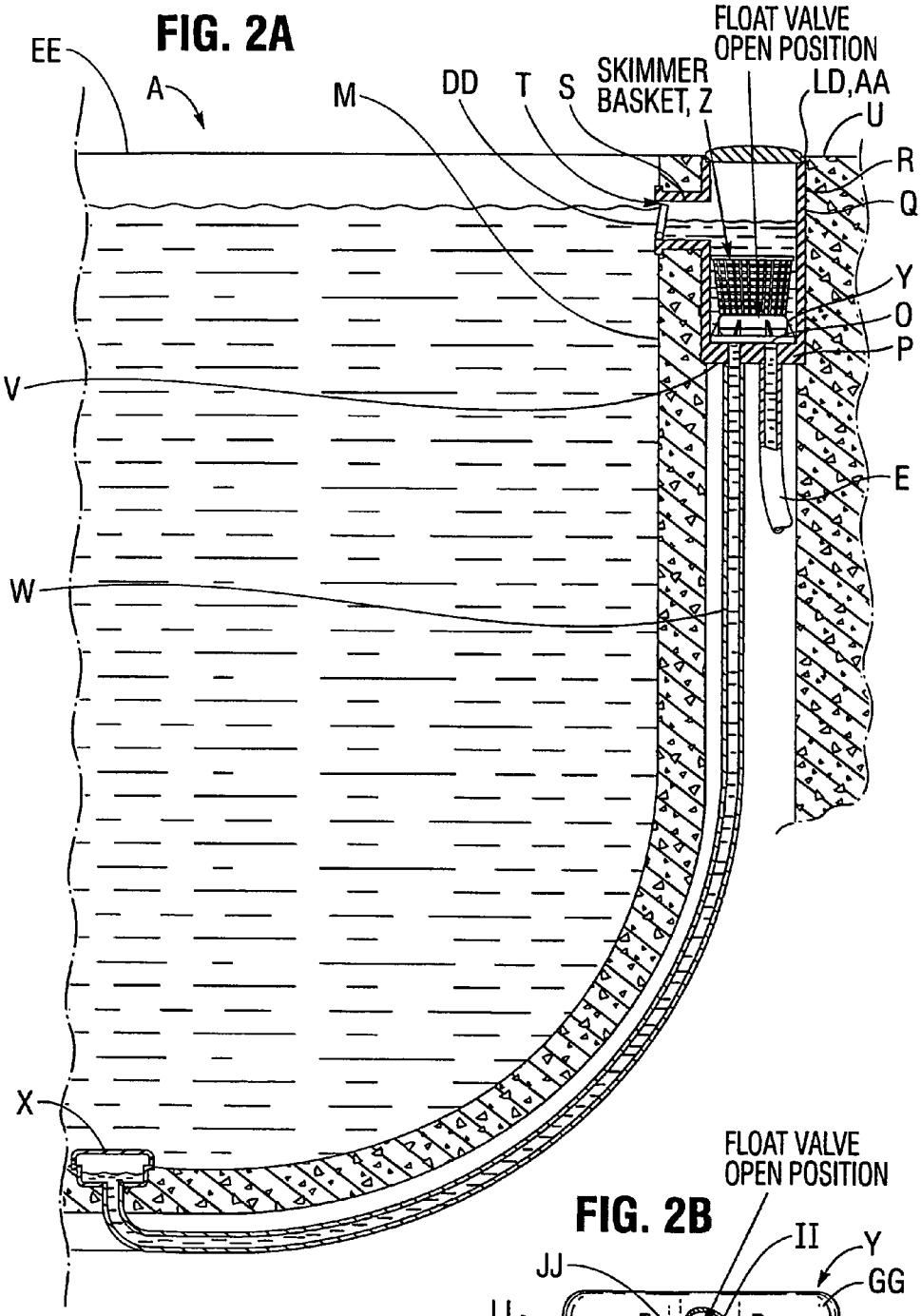
FIG. 2A is a transverse sectional view of the swimming pool shown in FIG. 1, on an enlarged scale and showing a skimmer thereof.
Figure 2B:
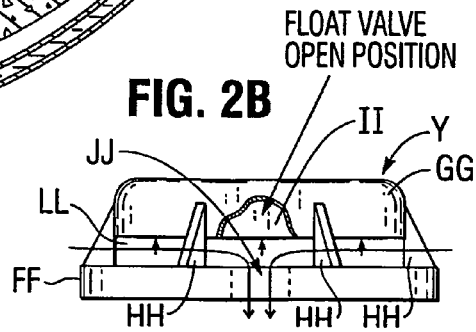
FIG. 2B is a fragmentary view of the structure of FIG. 2A, showing on an enlarged scale a skimmer valve with a float valve element thereof buoyed up to an upper, open position.

Referring to FIG. 1, it may be seen that a fire suppression system 20 according to the present invention includes a fire hose water distribution assembly 21 and a skimmer port flow diverter assembly 22 which are permanently and removably connectable, respectively, to various components of a conventional swimming pool A.

Swimming pool A, is of a conventional design which may have a basin shape different than that shown in FIG. 1, and may also include elements such as a gas-fired heater, solar heater, chlorinator and the like. Swimming pool A has certain basic features which are common to various types of pools with which system 20 may be implemented. Thus, as shown in FIG. 1, pool A includes a basin B which has a volume sufficiently large to hold a volume of water of suitable size for humans to swim or bathe in. For example, the pool shown in FIG. 1 may have a typical length of 30 ft., width of 10 ft., minimum depth of 3 ft., maximum depth of 9 ft., and hold about 15,000 gallons of water.

As shown in FIG. 1, swimming pool A includes a water circulation and filtration system B that includes a pump C which has a suction inlet port D that draws water from the pool through a suction inlet line E. Pump C has a discharge or outlet port F which is connected through interconnect piping G to the inlet port H of a filter I. Filter I has an outlet port J which is connected through return lines K to water inlet openings L in one or more side walls M of pool A.

FIG. 2 illustrates the structure and function of parts of pool A which implement water flow from the pool basin to the suction inlet line of water circulation/filtration system B.

Figures 4A, 4B, 4C:
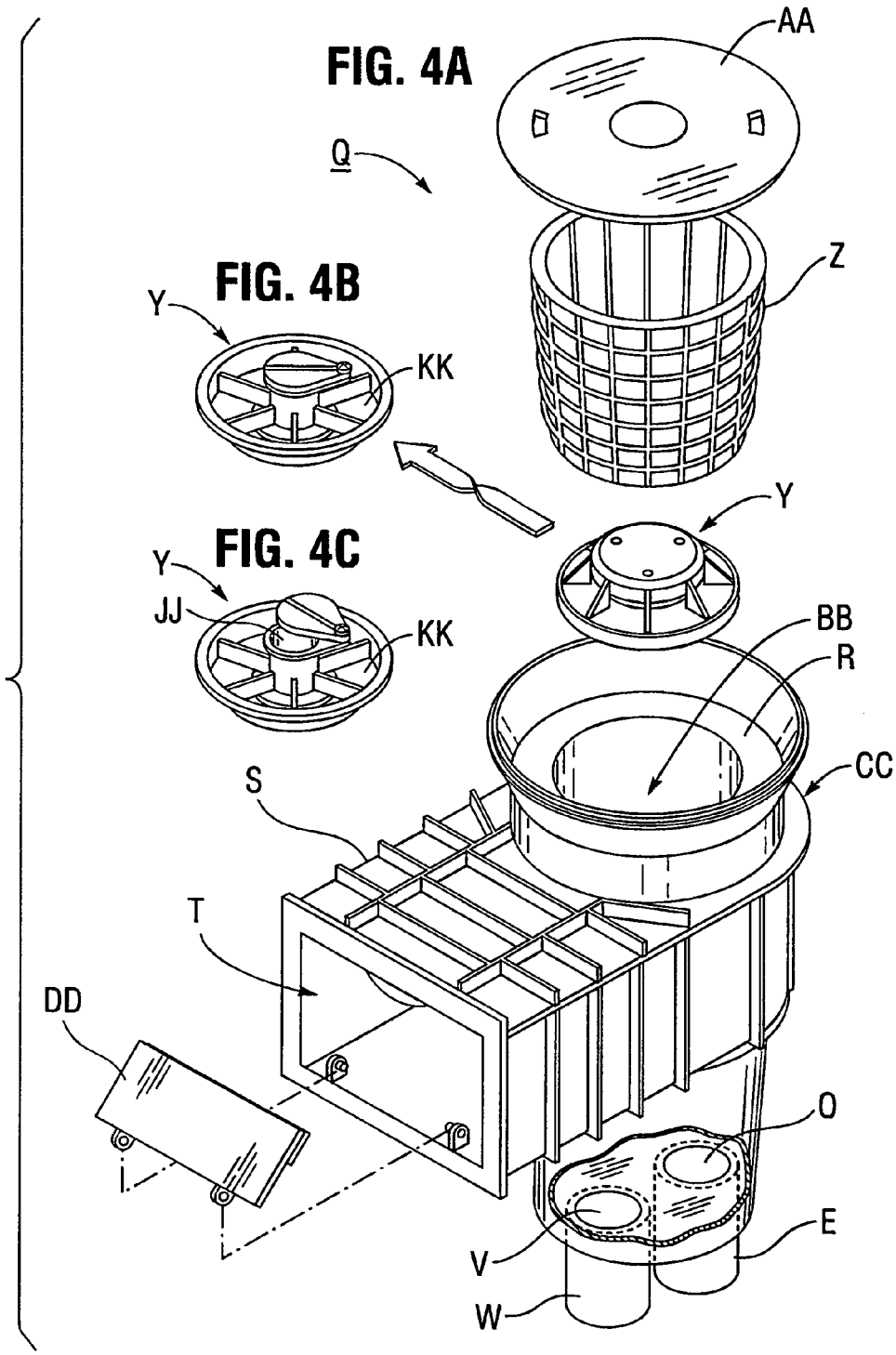
FIG. 4A is an exploded view of the skimmer of FIGS. 2 and 3, showing on a further enlarged scale details of the skimmer, including a skimmer debris basket and skimmer float valve which have been removed from the skimmer housing.
FIG. 4B is fragmentary lower plan view of the skimmer of FIG. 4A, showing a float valve thereof with a flow control vane positioned to enable maximum main-drain flow.
FIG. 4C is a view similar to that of FIG. 4B, but showing the flow control vane positioned for maximum surface skimmer flow.
Figure 5:
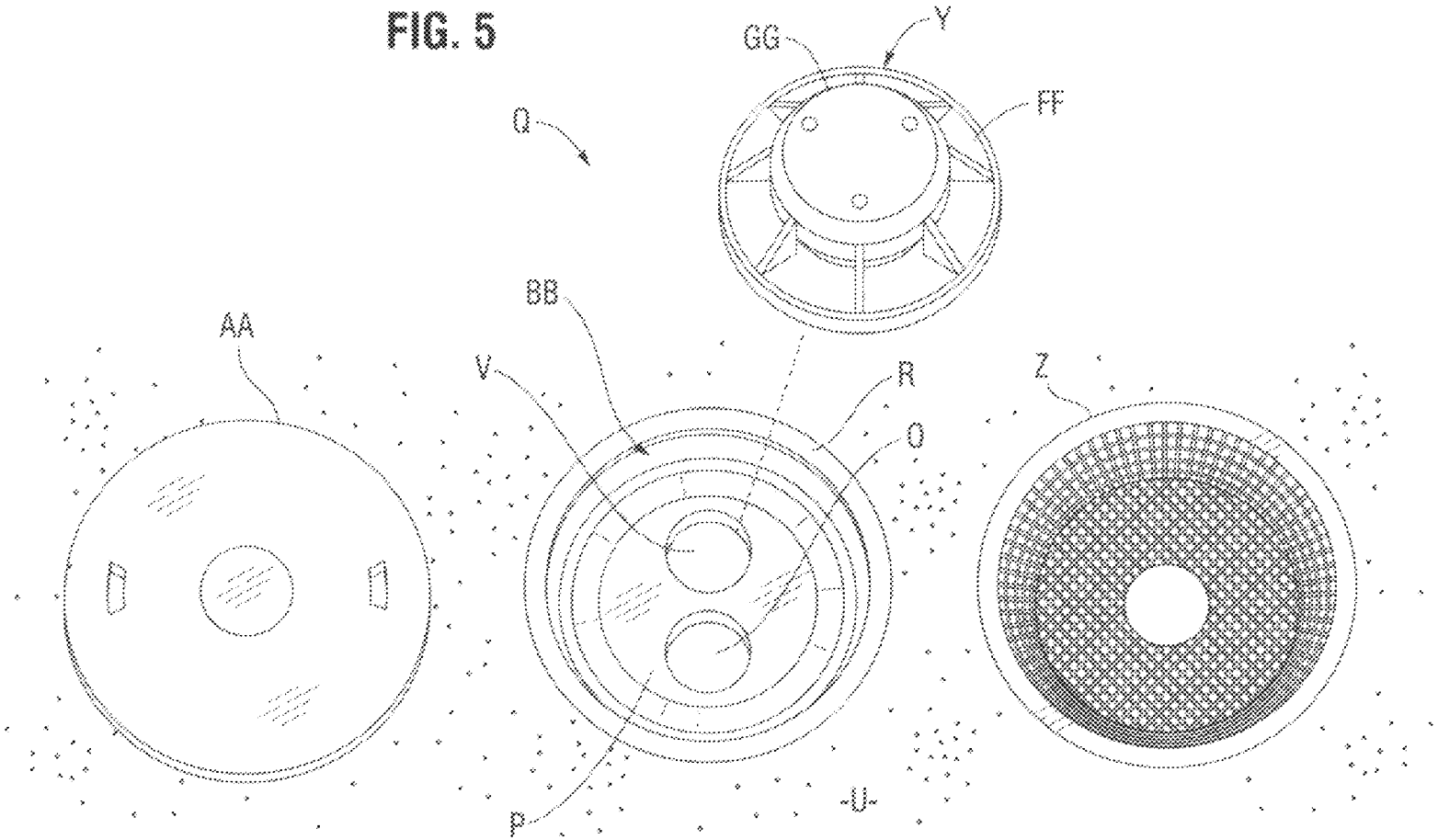
FIG. 5 is an upper plan view of the structure of FIG. 4, showing suction and main-drain port entrances in the base of the skimmer housing.

As shown in FIGS. 1 and 2, suction inlet line E is coupled at one end thereof to suction inlet port D of pump C, and at the other end N to a suction inlet port O consisting of a first circular opening which is located in the bottom wall or base P of a skimmer box Q. As shown in FIGS. 4 and 5 in addition to FIG. 2, skimmer Q includes a housing which has a hollow vertically disposed centrical tubular section R that has protruding horizontally therefrom a rectangular cross-section duct section S which has a laterally elongated rectangular opening T that penetrates a side wall M of pool A, near the upper deck surface U of the side wall. As shown in the figures, base P of skimmer Q has located therein a main-drain port V consisting of a second circular bore opening which is adjacent to suction inlet port O and coupled to a main-drain pipe W. The bore at a distal end of main-drain pipe W has an entrance opening which is covered by a perforated main-drain grate X that is typically located in the bottom wall of the pool, centered in its deepest part.

As may be seen best by referring to FIGS. 2 and 4, skimmer Q includes a generally circularly-shaped float valve Y which fits concentrically within the cylindrically-shaped bore of the cylindrical tube section R of the skimmer housing and rests on the upper surface of the housing base P. Skimmer Q also includes a skimmer debris basket Z which rests on the upper surface of float valve Y.

Skimmer Q also includes a lid AA which is removably insertable into the upper entrance opening of the bore in tubular section R of the skimmer housing.

Referring to FIGS. 2 and 4, it may be seen that skimmer Q includes a laterally elongated, rectangularly-shaped weir gate DD which is pivotably mounted in an outer entrance opening of duct T by a laterally disposed hinge located at the lower edge of the weir gate. Weir gate DD is constructed to be buoyant. Thus, as shown in FIG. 2, when the water level EE in pool A is higher than that of the bottom edge of the weir gate, the weir gate is maintained in a generally vertical position, and tilted slightly towards the skimmer's central axis because of the pressure of flowing water drawn into the skimmer and over the upper horizontal edge of the weir gate by suction action of the pump of suction inlet port O.

As shown in FIGS. 1-5, skimmer float valve Y includes a flat, annular ring-shaped base FF which rests conformally on base P of skimmer Q. Float valve Y includes an upper circular, inverted concave disk-shaped top plate GG which has a smaller diameter than base FF. Top plate GG is supported concentrically above the upper surface of the base FF by a plurality of thin circumferentially spaced apart ribs HH which protrude upwardly and radially inwardly from the base FF to the lower surface of the top plate GG. The top plate, ribs and base ring form therebetween a hollow space or cage LL in which is located a pancake-shaped, sealed hollow plastic buoyant float II that is normally buoyed up by water within the skimmer housing to an upper position in which the upper flat surface of the float is lodged against the underside of the top plate of the float valve, as shown in FIGS. 2A and 2B. In this position, water is drawn into the skimmer box by suction at the pump inlet port and flows in a water fall effect over the upper edge of the weir gate DD, downwardly and radially inwardly through the space between the bottom surface of the float II, downwardly through the central opening JJ of the float valve base ring FF, and thence into the suction inlet port opening D in the base P of the skimmer housing, which port is a circular opening flush with the base of the housing.

Figure 3A:
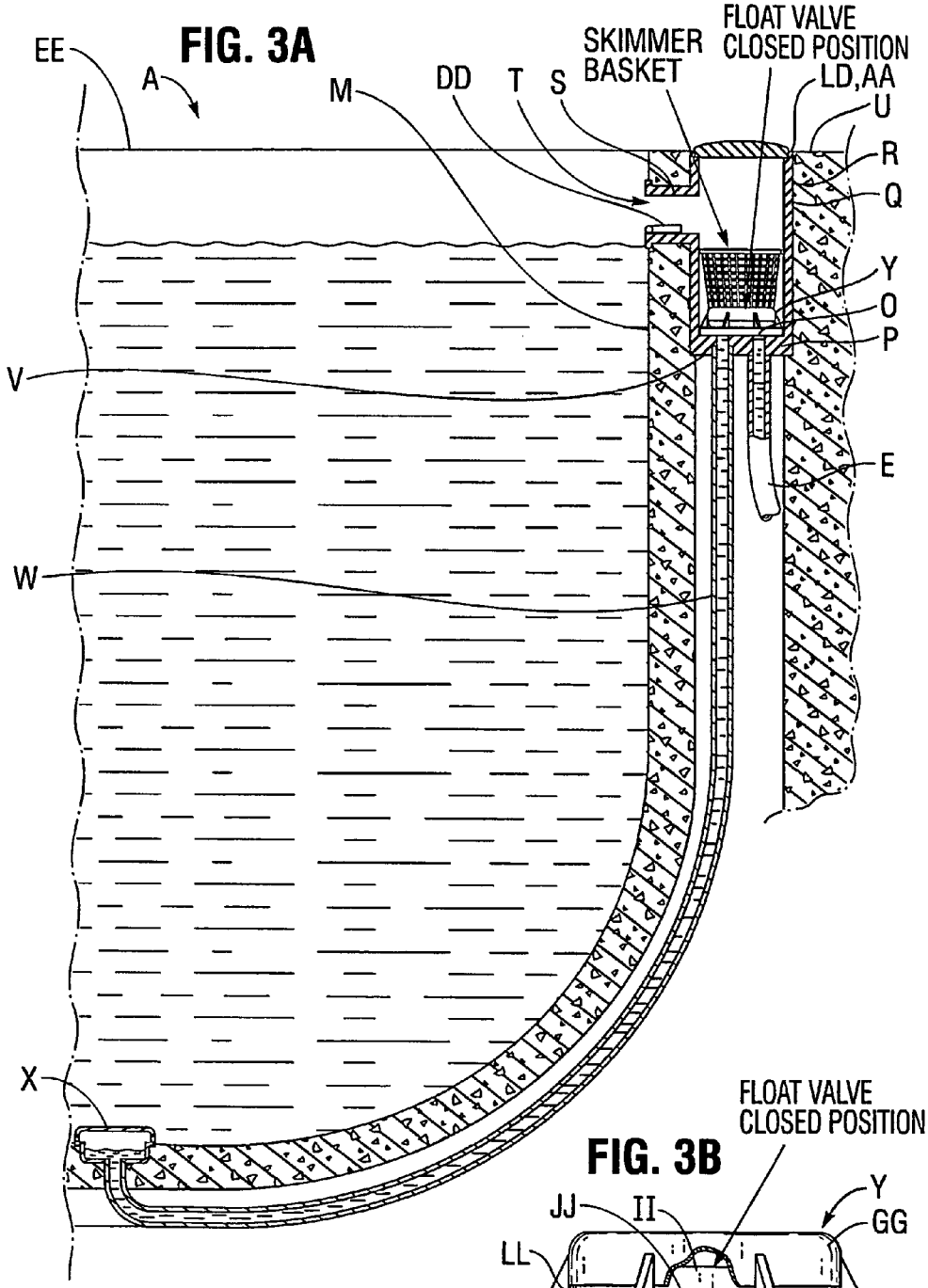
FIG. 3A is a view similar to that of FIG. 2, but showing the water level in the pool having been lowered below the weir gate entrance opening of the skimmer.
Figure 3B:
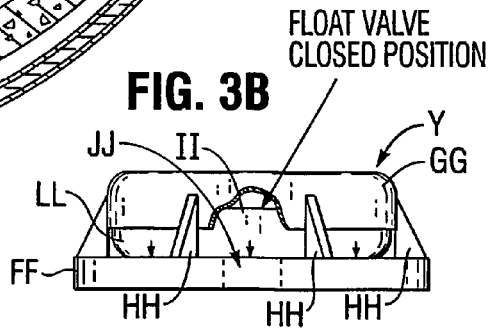
FIG. 3B is a fragmentary view of the structure of FIG. 3A, showing on an enlarged scale a skimmer valve with a float valve element thereof in a lower, closed position.

If, as shown in FIGS. 3A and 3B, the water level in the pool falls below that required to provide flow over the upper edge of the weir gate DD and into the pump suction inlet port O of the skimmer via the pathway discussed above, suction will quickly completely empty the water contained in the skimmer housing CC. Such action causes the skimmer float II, which is no longer buoyed up by water, to fall under the force of gravity onto the central circular entrance perforation JJ through the float valve base plate FF, thus sealing that opening against the ingress of air which could cause damage to the pool pump.

With the float II sealing the central opening JJ through the float valve base plate FF, water flow from the pool main-drain inlet port to the suction inlet port is enabled because the valve base plate has a concave lower surface KK which thus forms a concave space between the upper surface of the skimmer housing base and the lower surface of the valve base plate, the space forming airtight passageways between the two ports.

Water flowing upwardly from the drain port and horizontally and downwardly into the suction inlet port in the base of the skimmer housing enables water to be supplied to the pump and recirculated through the filter and water inlet ports of the pool. However, because of the restricted size of this flow path cross-section, the water flow rate is decreased to a small fraction, typically about one-tenth, of the normal pump flow rate. As a consequence, if water pumped from a pool of this type causes the level of water level to drop below that required to sustain flow through the skimmer weir gate opening, typically a drop of only about 6 to 8 inches, the water flow rate from any auxiliary valve and fire hose arrangement coupled to the pool water circulation system would drop to about one-tenth the normal flow rate. And, since the minimum practical flow rate for fire fighting purposes has been determined to be only slightly less than the maximum flow rate of a typical swimming pool circulation system, such a system would be unsuitable for pumping any but a small fraction of the total volume of water contained in the pool at a rate useful for fire fighting, i.e., a volume contained in at most the upper 8 inches, out of an average depth of six to eight feet or more.

Figure 6:
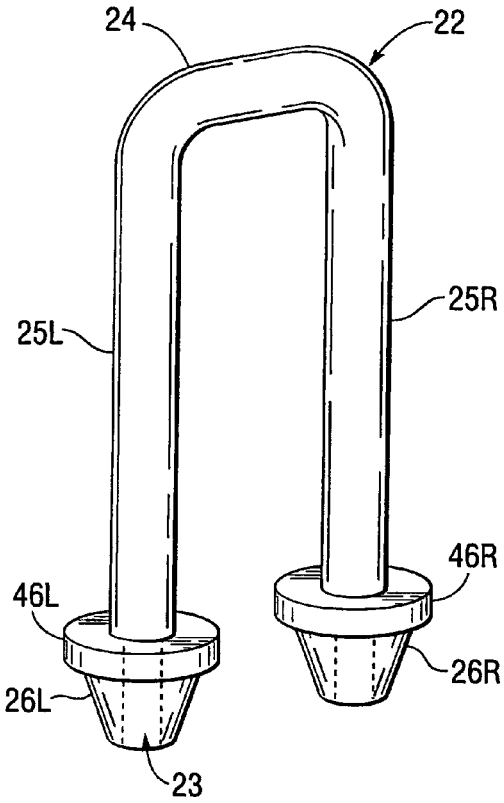
FIG. 6 is an elevation view of a skimmer port flow diverter assembly according to the present invention.
Figure 7:
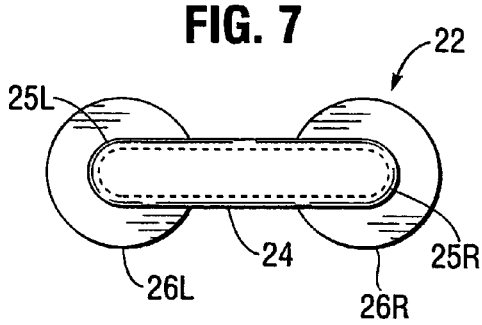
FIG. 7 is an upper plan view of the diverter assembly of FIG. 6.
Figure 8:
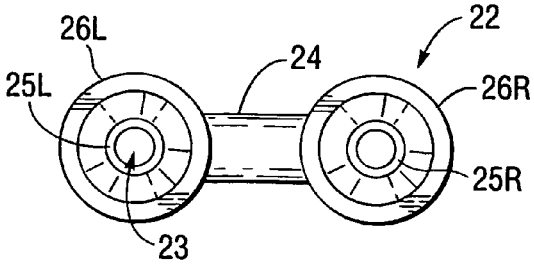
FIG. 8 is a lower plan view of the diverter assembly of FIG. 6.

The present invention includes a novel skimmer port diverter assembly 22 which enables substantially all of the water contained in a swimming pool to be pumped out of the pool at the maximum normal flow rate of the pool pump, and thus used to fight fires. As shown in FIGS. 6-8, a preferred embodiment of a diverter assembly 22 according to the present invention includes a length of PVC pipe which has a bore 23 that has a diameter at least as great as those of the suction inlet line and main-drain ports of a typical skimmer. The pipe is formed into the shape of an inverted U which has an upper horizontal leg 24 and at the opposite ends thereof, two parallel, vertically disposed downwardly depending legs 25L, 25R of equal length.

The lower end of each vertical leg 25L, 25R of the diverter assembly 22 has attached thereto a tapered bushing 26L, 26R which fits coaxially over the leg. Each bushing has an inverted frusto-conic shape and is made of an elastically deformable elastomeric material such as a natural or synthetic rubber, and is insertably receivable in a fluid pressure-tight sealing contact into the upper entrance openings of the suction and main-drain ports, respectively, at the bottom of a skimmer housing. The function and manner of use of the novel skimmer port diverter assembly 22 are described below.

Figures 9, 10:
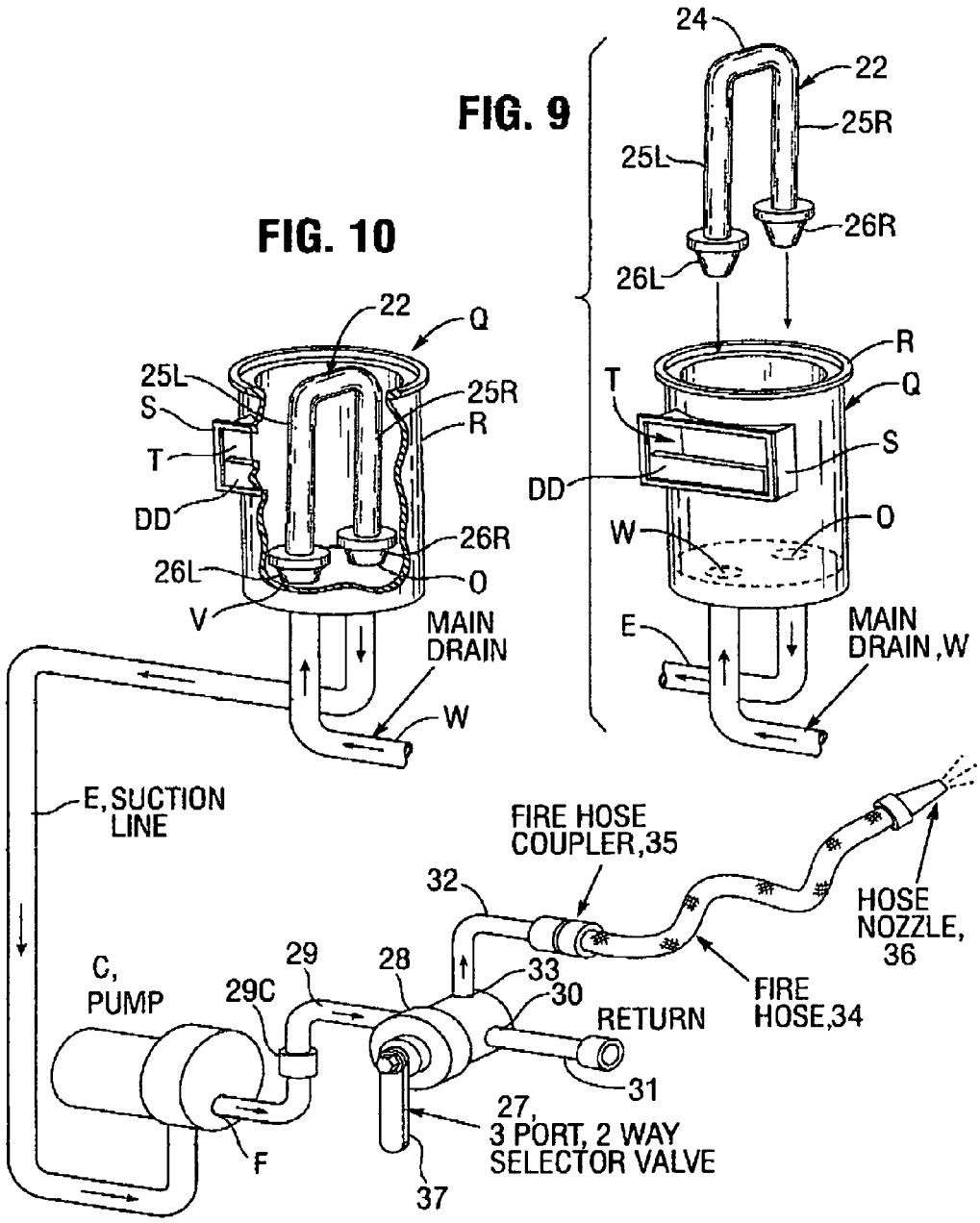
FIG. 9 is a fragmentary view of the fire suppression system of FIG. 1, showing the manner of installing the skimmer port diverter assembly of FIGS. 6-8 in a skimmer of a swimming pool.
FIG. 10 is a partly diagrammatic view of the fire suppression system of FIGS. 1 and 9, showing the diverter assembly of FIGS. 6-8 fitted into the skimmer ports shown in FIG. 5.

As shown in FIGS. 1 and 10, a fire suppression apparatus system 20 for use with swimming pools according to the present invention includes a three-port, two-way selector valve 27. The selector valve 27 has an inlet port 28 which is coupled by an inlet pipe 29 to the outlet or discharge port E of a swimming pool water circulation pump C, and a first outlet port 30 which is connected by a first, normal-use outlet pipe 31 to the pool filter I. The selector valve 27 may be installed in the pool water circulation plumbing at the time the pool equipment is initially installed.

In those situations where the fire suppression system 20 according to the present invention is to be retrofitted to an existing swimming pool water circulation system, a length of pipe G originally connecting the outlet or discharge port E of the circulation pump C to the inlet port H of the filter I is severed and removed. Since most swimming pools use PVC pipe in their plumbing systems, removal of the required length of pipe from the pump discharge path may be readily accomplished by making two longitudinally spaced apart hack saw cuts through the pipe. The cut end of the pipe connected to the pump is then coupled to the inlet port pipe 29 of the selector valve 27, using a conventional fluid pressure-tight coupler 29C. In the same fashion, the cut end of the filter inlet pipe is coupled in a fluid pressure-tight connection to a first outlet port 30 of the selector valve.

A fire suppression system according to the present invention includes a length of pipe 32 coupled at one end thereof in a fluid pressure-tight connection to a second outlet port 33 of the selector valve. The other end of the pipe 32 is coupled to an inlet end of a standard flexible fire hose 34, preferably using a quick-disconnect coupler 35. A standard nozzle 36 suitable for fire fighting is attached to the outlet end of the fire hose. The fire hose may be stored in a folded configuration, or optionally wound around a rotatable storage reel. (Not shown.)

To use the fire suppression system according to the present invention, a circular skimmer box lid AA which fits into the upper circular entrance opening BB of the skimmer box housing CC flush with the surface U of the deck that peripherally surrounds the pool A is removed, allowing access to the interior of the skimmer housing. The skimmer filter basket Z and skimmer float valve Y are then lifted upwards and out from the skimmer housing.

Next, the skimmer port flow diverter assembly 22 described above is positioned vertically above the upper entrance opening of the now vacant skimmer housing, and pushed downwards into the skimmer housing until the two tapered rubber bushings 26L, 26R at the lower ends of the diverter assembly legs 25L, 25R seat in the upper entrance openings of the suction inlet port O and main-drain port V, which are located side-by-side in the base P of the skimmer housing. Preferably, installation of the diverter assembly 22 is done with the pool pump operating, suction on a bushing 26L or 26R at the end a diverter assembly leg inserted into the suction inlet port facilitating secure coupling between both bushings of the diverter assembly and the suction inlet and main-drain bores O and V, and thus ensuring a fluid pressure-tight coupling between those two bores and bore 23 through the diverter pipe assembly.

In a preferred embodiment of diverter assembly 22 shown in FIG. 6, each tapered bushing 26L, 26R has located at the upper end thereof a thin, circular ring-shaped flange 46R, 46L which fits coaxially over legs 25L, 25R, and which is continuous with or fastened to the upper surface of the bushing. Flanges 46R, 46L limit the insertion depth of bushings 26L, 26R into bores U and V, and assist in forming fluid pressure-tight seals with the upper surface of base P of skimmer Q.

A handle 37 of the selector valve 27 of the fire suppression apparatus 20 according to the present invention is then manually re-positioned to re-route discharge water flow from the pool pump from a normal-use position, conducted to the filter I, to a fire-fighting position, conducted through the second outlet port 33 of the selector valve 27 through the outlet pipe 32, fire hose connector 35, fire hose 34 and nozzle 36.

With the fire suppression apparatus according to the present invention configured as described above, water contained in the pool basin B may be pumped through the fire hose 34 at the maximum discharge pressure and flow rate of which the pump C is capable, until the water level in the pool has dropped to the level of the main-drain and, since the main-drain is customarily located at the lowest elevation of a pool, the fire suppression apparatus according to the present invention is useable to pump from the pool essentially all of the water contained in the pool at full pressure to fight fires.

From the foregoing description of the construction and function of diverter assembly 22, it should be clear to one skilled in the art that construction details of the diverter assembly could be varied without detracting from its novelty and usefulness. For example, the PVC pipe formed into an inverted U-shape including a base leg 24 and upright legs 25L, 25R could have different shapes, and could be replaced by a flexible conduit provided that the conduit was of a type which would not collapse in response to suction, or negative pressure, exerted on the conduit by the suction inlet line of the pool pump.

The present inventor has also discovered additional applications for the novel diverter assembly 22. For example, it is sometimes desirable to periodically change the water flow pattern in a swimming pool, to enable all of the water drawn into the suction inlet port of the pool pump to be drawn into the main drain, and at the maximum flow rate permitted by the pump and filter. This maximum flow rate through the main-drain is desirable, for example, when "shocking" the pool, i.e., adding dry chemicals with a high available chlorine content to the pool to quickly increase the chlorination level of the pool water.

Also, swimming pools periodically need to be completely drained, to remove water in which the total dissolved solids (TDS) concentration has become too high. Draining the pool completely usually requires use of submersible pumps. However, because the novel design and construction of diverter assembly 22 enables draining substantially all of the water from a swimming pool, at the maximum flow rate achievable by the existing pool pump, the diverter assembly 22 provides a very convenient means for drawing water from the main-drain outlet of the pool at maximum flow rate, for applications such as the two described above.

What is claimed is:

1. A swimming pool skimmer port flow diverter assembly for facilitating water flow from the main-drain to the suction inlet port of a swimming pool pump at substantially the maximum flow rate of the pump, said skimmer port flow diverter assembly comprising;

a. an elongated tubular conduit, b. a first elastomeric bushing located at a first end of said conduit, said bushing protruding longitudinally outwards of a first transverse end of said conduit, c. a second elastomer bushing located at a second end of said end of said conduit, said bushing protruding longitudinally outwards of a second transverse end of said conduit, and d. said first and second longitudinally outwardly protruding ends of said first and second bushings being insertable in first and second fluid-tight fits into first and second entrance openings of bores of a skimmer suction inlet line and main-drain line of a swimming pool skimmer box.

2. The diverter assembly of claim 1 wherein said conduit is insertably received in a bore through at least one of said bushings.

3. The diverter assembly of claim 1 wherein each of said first and second elastomeric bushings is further defined as having a conically tapered shape including a longitudinally inwardly located base, and a longitudinally outwardly located truncated apex.

4. The diverter assembly of claim 3 wherein at least one of said first and second bushings has located at a longitudinally inwardly located base end thereof a concentrically located, ring-shaped flange which protrudes radially outwards of said base.

5. The diverter assembly of claim 1 wherein said conduit has generally an inverted U-shape.

6. The diverter assembly of claim 1 wherein said conduit is further defined as being a substantially rigid pipe.

7. The diverter assembly of claim 1 wherein said conduit has a fluid-flow cross section substantially as large as that of the largest of the bores of said suction and main-drain lines.

8. A fire suppression system for use with swimming pools comprising;

a. the diverter assembly of claim 1, b. a three-port two-way selector valve having an inlet port connectable in a fluid pressure-tight connection to an outlet discharge port of a swimming pool pump, a first, outlet port connectable in a fluid pressure-tight connection to the inlet port of a swimming pool filter, and a second outlet port connectable in a fluid pressure-tight connection to the inlet port fitting of a fire hose, said valve having a control lever for configuring said valve to alternatively conduct pressurized water flow from said outlet port of said pump to said first and second outlet ports of said valve.

9. The fire suppression system of claim 8 further including a fire hose connected at a first, inlet end thereof to said second outlet port of said valve.

10. The fire suppression system of claim 9 further including a spray nozzle connected to a second, outlet end of said fire hose.

11. A swimming pool skimmer port flow diverter assembly for facilitating water flow from the main-drain to the suction inlet port of a swimming pool pump at substantially the maximum flow rate of the pump, said skimmer port flow diverter assembly comprising;

a. an elongated pipe having substantially the shape of an inverted U including an upper laterally disposed horizontal leg having at laterally opposed ends thereof first and second downwardly depending vertical legs, and b. first and second tapered elastomeric bushings fastened coaxially over lower ends of said first and second vertical legs of said pipe, said bushings having each an upper transversely disposed annular face and a lower transversely disposed annular face of smaller diameter than said upper face, said lower face being located below a lower annular end wall of said pipe.

12. The diverter assembly of claim 11 wherein each of said bushings is further defined as having generally an inverted frusto-conic shape.

13. The diverter assembly of claim 11 wherein said pipe has an internal bore diameter substantially as large as the largest of the bores of said suction and main-drain lines.

14. A fire suppression system for use with swimming pools comprising;

a. the diverter assembly of claim 11, b. a three-port two-way selector valve having an inlet port connectable in a fluid pressure-tight connection to an outlet discharge port of a swimming pool pump, a first, outlet port connectable in a fluid pressure-tight connection to the inlet port of a swimming pool filter, and a second outlet port connectable in a fluid pressure-tight connection to the inlet port fitting of a fire hose, said valve having a control lever for configuring said valve to alternatively conduct pressurized water flow from said outlet port of said pump to said first and second outlet ports of said valve.

15. The fire suppression system of claim 14, further including a fire hose connected at a first, inlet end thereof to said second outlet port of said valve.

16. The fire suppression system of claim 15 further including a spray nozzle connected to a second, outlet end of said fire hose.

* * * * *